US005988234A

United States Patent [19]

Wegman

[11] Patent Number: 5,988,234

[45] Date of Patent: Nov. 23, 1999

[54] APPARATUS FOR PARTICULATE PROCESSING

[75] Inventor: Paul M. Wegman, Pittsford, N.Y.

[73] Assignee: Xerox Corporation, Stamford, Conn.

[21] Appl. No.: 09/061,122

[22] Filed: Apr. 16, 1998

[51] Int. Cl.[6] ..... B65B 1/04

[52] U.S. Cl. ..... 141/67; 141/93; 141/286

[58] Field of Search ..... 141/67, 69, 285, 141/286, 93

[56] References Cited

U.S. PATENT DOCUMENTS

| | | | |
|---|---|---|---|
| 4,185,669 | 1/1980 | Jevakohoff | 141/286 |
| 4,974,646 | 12/1990 | Martin et al. | 141/67 |
| 5,227,460 | 7/1993 | Mahabadi et al. | 528/272 |
| 5,531,253 | 7/1996 | Nishiyama et al. | 141/90 |
| 5,598,876 | 2/1997 | Zanini et al. | 141/67 |
| 5,685,348 | 11/1997 | Wegman et al. | 141/2 |
| 5,699,842 | 12/1997 | Wegman | 141/369 |
| 5,727,607 | 3/1998 | Ichikawa et al. | 141/67 |

*Primary Examiner*—Steven O. Douglas
*Attorney, Agent, or Firm*—John L. Haack

[57] ABSTRACT

An apparatus including:

a funnel comprising a housing operably connected to a particulate source at one end and extending downwardly therefrom to a receiver member at the other end, the funnel being adapted to permit a flow of powder therethrough, and wherein the inner wall of the funnel is adapted with a porous member which provides a boundary layer of gas between the porous member and the powder.

18 Claims, 2 Drawing Sheets

FIG. 1
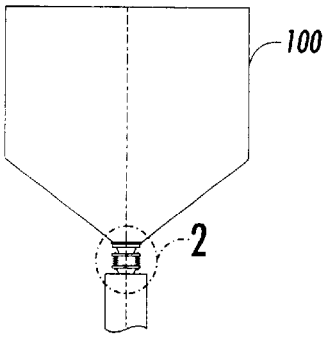
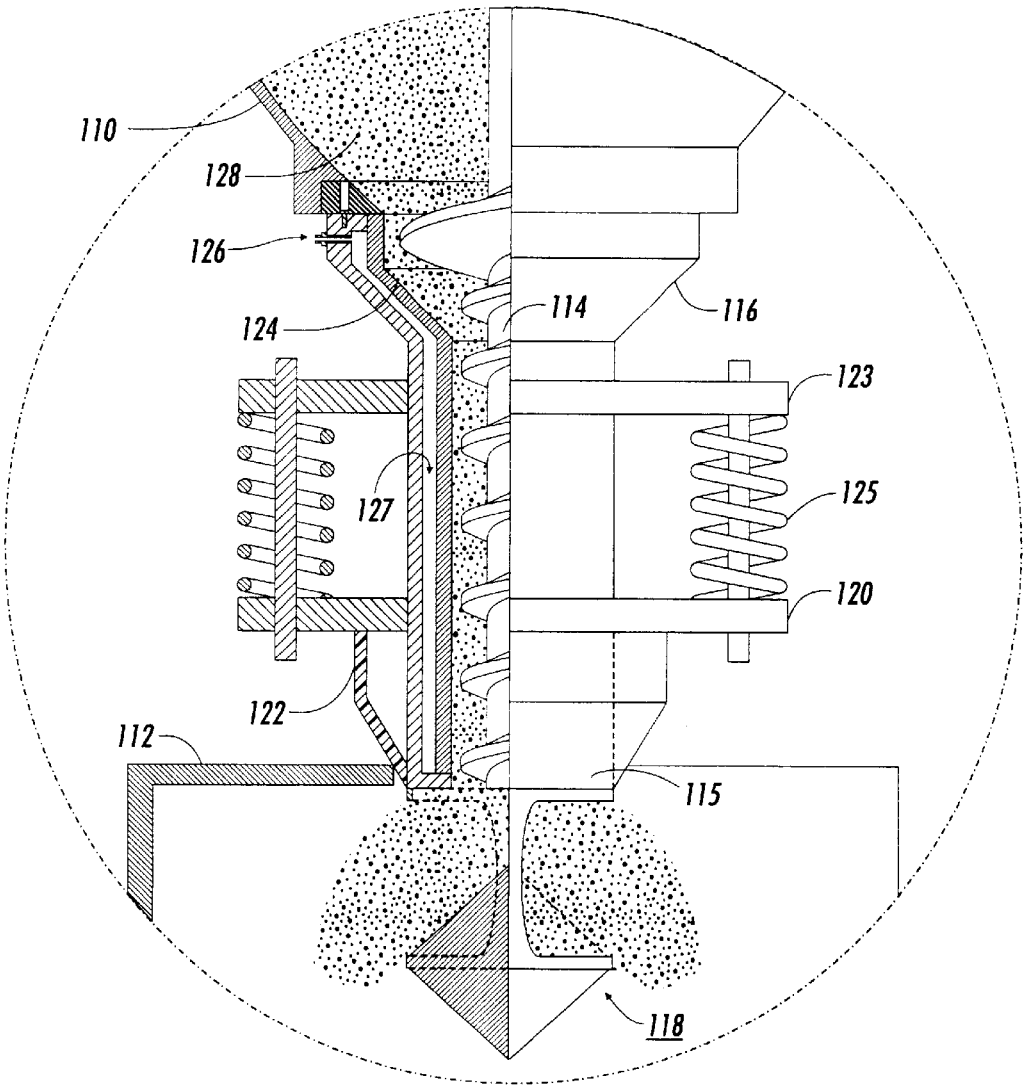
FIG. 2

FIG. 3
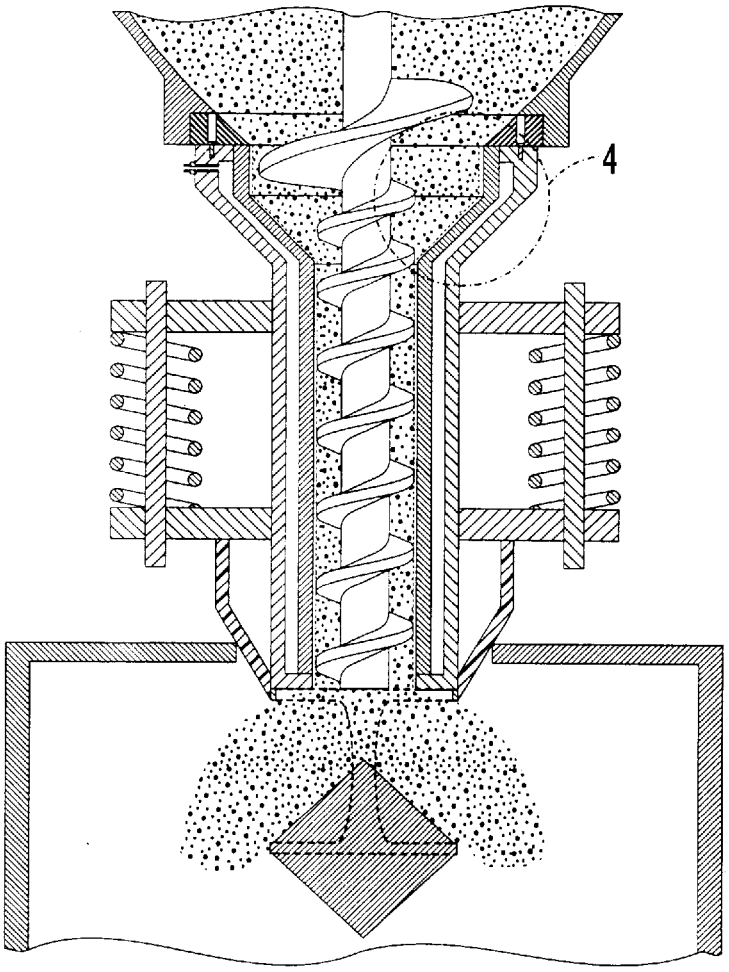
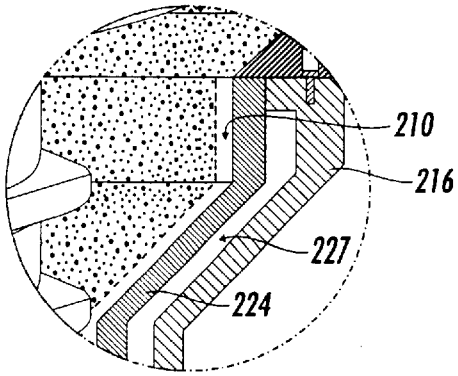
FIG. 4

APPARATUS FOR PARTICULATE PROCESSING

CROSS REFERENCE TO COPENDING APPLICATIONS AND RELATED PATENTS

Attention is directed to commonly owned and assigned U.S. Pat. No. 5,685,348, issued Nov. 11, 1997, entitled "ELECTROMAGNETIC FILLER FOR TONER"; and U.S. Pat. No. 5,699,842, issued Dec. 23, 1997, entitled "MAGNETIC FILLING AND MIXING APPARATUS AND PROCESSES THEREOF".

Attention is directed to commonly assigned copending applications: U.S. Pat. No. 08/829,925 (D/97058), filed Apr. 1, 1997, entitled "OSCILLATING VALVE FOR POWDERS" which discloses a method for filling a powder container with a supply of powder in a vessel, comprising: placing a first powder container to be filled in filling relationship to a discharge feature in the vessel; directing the powder in the vessel toward a member located at least partially within the vessel, the member defining a restriction therein such that the powder clogs within the restriction; mechanically exciting the powder at least adjacent the restriction to improve the flow properties of the powder so as to unclog the powder within the restriction; dispensing powder through the restriction, through the discharge feature and into the first container; stopping the mechanical excitation of the powder so as to clog the restriction with the powder; removing the first container from the vessel; and placing a second container to be filled in filling relationship to the vessel; U.S. Pat. No. 08/823,034 (D/96600), now U.S. Pat. No. 5,909,829, filed Apr. 1, 1997 entitled "TONER VIBRO-CONDITIONING SYSTEM FOR AUGERLESS FILLERS", which discloses a method for filling a powder container, comprising: placing a first powder container to be filled in filling relationship to a supply of powder in a vessel; mechanically exciting the powder in the vessel to improve its flow properties; dispensing powder from the vessel into the first container; removing the first container from the vessel; and placing a second container to be filled in filling relationship to the vessel; U.S. Pat. No. 08/540,993 (D/95051), Now U.S. Pat. No. 5,839,485, filed Oct. 12, 1995, entitled "ELECTROMAGNETIC VALUE AND DEMAGNETIZING CIRCUIT" which discloses a method for controlling filling a container, comprising: placing a first container to be filled in filling relationship to a fill tube; moving a magnetic material from a source thereof through the fill tube to fill the first container with the material; applying a magnetic force to the material in the fill tube once the first container is filled, the magnetic force being sufficient to hold the material in place in the fill tube; removing the first container; placing a second container to be filled in filling relationship to the fill tube; and removing the magnetic force applied to the material so that the material can move through the fill tube and into the second container; and U.S. Pat. No. 08/923,016 (D/97358), now U.S. Pat. No. 5,921,295, filed Sep. 3, 1997, entitled "HIGH SPEED NOZZLE FOR TONER FILLING SYSTEMS" which discloses an apparatus for assisting in filling a container from a hopper containing a supply of powder including a conduit operably connected to the hopper and extending downwardly therefrom and adapted to permit a flow of powder therewith in.

The disclosures of each the above mentioned patents and copending applications are incorporated herein by reference in their entirety. The appropriate components, devices, and processes of these patents may be selected for the components, devices, toners and processes of the present invention in embodiments thereof.

BACKGROUND OF THE INVENTION

This invention relates generally to filling a container with material, and more particularly concerns a fill nozzle for controlling the flow of powders such as toner from a fill tube to a toner container.

Currently when filling powders, for example toners into toner containers, toner is transported from the toner supply hopper into the container by a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner friction. High auger speed will cause the toner to melt, particularly for low melt toner such as disclosed in U.S. Pat. No. 5,227,460 to Mahabadi et al. the relevant portions thereof incorporated herein by reference.

To provide for productive efficient toner containers, typically, the rotating augers used to transport the toner from hoppers are relatively large. The large augers provide for high volume toner flow and thus improve productivity in a fill line. When utilizing such fill lines for small, low cost copiers and printers, difficulties occur in that the openings in the toner containers utilizing such small copiers and printers include a small toner fill opening that may have an irregular shape and have a fill opening that is not centrally located in the container. Problems are thus associated with fitting the large filling tubes and augers with the small toner fill openings.

Problems with filling containers with toner are exacerbated in that the small low cost copies are produced in higher quantities necessitating very efficient toner filling operations.

Problems with efficient toner filling are also apparent in small and medium cost multi-colored highlight or full color printers and copiers. The toner containers for color toner typically are smaller than those for black toner and also more typically have an irregular shape. Further, color toners have been developed with smaller particle size of for example 7 microns or less. These smaller toners are more difficult to flow through toner hoppers and are more difficult to be translated along augers.

Toner containers for small low cost printers and copiers typically have a small opening into which the toner is to be added. Furthermore, the toner containers often have irregular shapes to conform to the allotted space within the copying machine. Therefore it becomes difficult to fill the toner container because of the small tube required to fit into the small toner container opening and secondly for all the toner within the container to completely fill the remote portions of the container before the container overflows.

The problems associated with controlling the filling of toner containers are due primarily to the properties of the toner. Toner is the image-forming material in a developer which when deposited by the field of an electrostatic charge becomes the visible record. There are two different types of developing systems known as onecomponent and two-component systems.

In one-component developing systems, the developer material is toner made of particles of magnetic material, usually iron, embedded in a black plastic resin. The iron enables the toner to be magnetically charged. In two-component systems, the developer material is comprised of toner which consists of small polymer or resin particles and a color agent, and carrier which consists of roughly spherical particles or beads usually made of steel. An electrostatic charge between the toner and the carrier bead causes the toner to cling to the carrier in the development process. Control of the flow of these small, abrasive and easily charged particles is very difficult.

The one-component and two-component systems utilize toner that is very difficult to flow. This is particularly true of the toner used in two component systems, but also for toner for single component systems. The toner tends to cake and bridge within the hopper. This limits the flow of toner through the small tubes which are required for addition of the toner through the opening of the toner container. Also, this tendency to cake and bridge may cause air gaps to form in the container resulting in partial filling of the container.

Attempts to improve the flow of toner have also included the use of an external vibrating device to loosen the toner within the hopper. These vibrators are energy intensive, costly and not entirely effective and consistent. Furthermore, they tend to cause the toner to cloud causing dirt to accumulate around the filling operation.

Also, difficulties have occurred in quickly starting and stopping the flow of toner from the hopper when filling the container with toner in a high speed production filling operation. An electromagnetic toner valve has been developed as described in U.S. patent applications, Ser. Nos. 08/540,993 and 08/690,412, assigned to the same assignee as this application, the relevant portions incorporated herein by reference. The electromagnetic valve is limited for use with magnetizable toner such as that described for use with one component development systems.

Attempts have been made to fill toner containers having small toner fill openings by utilizing adapters positioned on the end of the toner filling auger which has an inlet corresponding to the size of the auger and an outlet corresponding to the opening in the toner container. Clogging with toner, particularly when attempting to increase toner flow rates and when utilizing toners with smaller particle size, for example, color toners having a particle size of 7 microns or less, has been found to be a perplexing problem. The adapters that are fitted to the augers, thus, tend to clog with toner. The flow rates through such adapters is unacceptably low.

Further, the use of these adapters may create problems with maintaining a clean atmosphere free of toner dust at the filling operation.

The following disclosures may be relevant to various aspects of the present invention:

U.S. Pat. No. 5,531,253
Patentee: Nishiyama et al.
Issue Date: Jul. 2, 1996
U.S. patent application Ser. No. 08/540,993
Applicant: Wegman et al
Filing Date: Oct. 12, 1995
U.S. patent application Ser. No. 08/690,412
Applicant: Wegman et al
Filing Date: Jul. 22, 1996
U.S. patent application Ser. No. 08/829,925
Applicant: Wegman et al
Filing Date: Apr. 1, 1997
U.S. patent application Ser. No. 08/823,034
Applicant: Wegman et al
Filing Date: Apr. 1, 1997 The portions of the foregoing disclosures may be briefly summarized as follows:

U.S. Pat. No. 5,531,253 discloses a cleaner for cleaning the nozzle portion of a powder filling apparatus by equally evacuating the inside and the outside of the container and dropping powder through the nozzle portion into the container simultaneously with the raising the pressure outside the container.

U.S. patent application Ser. No. 08/540,993, filed Oct. 12, 1995, entitled "Electromagnetic Valve and Demagnetizing Circuit", by Wegman et al., discloses a method and apparatus for filling a container with a magnetic material using an electromagnetic valve and a demagnetizing circuit to control the flow and properties of the material. In the filling process an auger located inside of the fill tube rotates and moves the material through the fill tube. When the container is filled, the auger stops rotating and the electromagnetic valve is actuated. The electromagnetic valve supplies a magnetic field which holds the material in place, plugging the fill tube with the material as the container is removed and a new container is placed to be filled. When the electromagnetic valve is switched off, a demagnetizing circuit is activated. After the material is demagnetized the auger is switched on and the material flows again to fill the container.

U.S. patent application Ser. No. 08/690,412, discloses a method and apparatus for filling a container with toner using a series of traveling magnetic fields to control the flow of toner from a supply of toner to the container. Initially, an empty container is placed under a fill tube through which the toner will be supplied to the container. In the filling process the traveling magnetic fields, which are supplied by turning on and off a series of solenoids, and gravity cause toner from the toner supply to move through the fill tube. When a solenoid is turned on toner particles are attracted to its magnetic field where a plug of toner is formed. The solenoids are controlled so that a discrete amount of toner is supplied in each on/off cycle of the solenoids. The solenoid on/off cycle is repeated until the container is filled with toner. When the container is filled, the appropriate solenoid is activated so that a plug of toner stops the flow of toner in the fill tube. The filled container is removed from the fill tube and an empty container is put in its place so that the solenoid on/off cycle may begin again.

U.S. patent application Ser. No. 08/829,925 filed Apr. 1, 1997, entitled "Oscillating Valve for Powders", Wegman et al., discloses a method for filling a powder container. The method includes the steps of placing a first powder container to be filled in filling relationship to a discharge feature in the vessel, directing the powder in the vessel toward a member located at least partially within the vessel, the member defining a restriction therein such that the powder clogs within the restriction, mechanically exciting the powder at least adjacent the restriction to improve the flow properties of the powder so as to unclog the powder within the restriction, dispensing powder through the restriction, through the discharge feature and into the first container, stopping the mechanical excitation of the powder so as to clog the restriction with the powder, removing the first container from the vessel, and placing a second container to be filled in filling relationship to the vessel.

U.S. patent application Ser. No. 08/823,034 filed Apr. 1, 1997, entitled "Vibratory Filler for Powders", Wegman et al., discloses a method for filling a powder container. The method includes the steps of placing a first powder container to be filled in filling relationship to a supply of powder in a vessel, mechanically exciting the powder in the vessel to improve its flow properties, dispensing powder from the vessel into the first container, removing the first container from the vessel, and placing a second container to be filled in filling relationship to the vessel.

The above are hereby incorporated by reference in their entirety.

SUMMARY OF THE INVENTION

Embodiments of the present invention, include:

Overcoming or minimizing problems encountered in the art by providing particulate handling and filling equipment, which enables improved manufacturing efficiency and material throughput;

An apparatus comprising:

a funnel comprising a housing operably connected to a particulate source at one end and extending downwardly therefrom to a receiver member at the other end, the funnel being adapted to permit a flow of powder therethrough, and wherein the inner wall of the funnel is adapted with a porous member which provides a boundary layer of gas between the porous member and the powder; and A method comprising:

placing a first powder container to be filled in filling relationship to a funnel extending downwardly from a hopper;

directing the powder in the hopper toward a funnel located at least partially within the hopper, the funnel defining a restriction therein;

defining an inlet cross sectional area perpendicular to the flow the powder and outlet defining an outlet cross sectional area perpendicular to the flow the powder;

selecting the inlet cross sectional area to be larger than the outlet cross sectional area;

selecting the dimensions of the funnel to provide a ratio of the inlet cross sectional area to the outlet cross sectional area such that the flow of powder does not seize as it progresses through the nozzle;

dispensing powder from the hopper through the funnel feature and into a first container;

removing the first container from the funnel; and placing a second container to be filled in filling relationship to the hopper.

These and other aspects are achieved, in embodiments, of the present invention and as described and illustrated herein.

BRIEF DESCRIPTION OF THE DRAWINGS

Other features of the present invention will become apparent as the following description proceeds and upon reference to the drawings, in which:

FIG. 1 is a side view of the apparatus of the present invention shown interposed between a source hopper and a receiving member;

FIG. 2 is a side view in partial cross section of the apparatus of the present invention.

FIGS. 3 and 4 are cross-sectional side views of the apparatus of the present invention showing the inner wall as a porous member which provides a boundary layer of gas between the porous member and the processed powder.

DETAILED DESCRIPTION OF THE INVENTION

The present invention provides a highly reliable powder dispensing and filling apparatus and method thereof and which apparatus and method can be used in high volume continuously filling operations, for example, in packaging xerographic toners and developers.

In embodiments the present invention provides:

An apparatus comprising:

a funnel comprising a housing operably connected to a particulate source at one end and extending downwardly therefrom to a receiver member at the other end, the funnel being adapted to permit a flow of powder therethrough, and wherein the inner wall of the funnel is adapted with a porous member which provides a gas boundary layer between the porous member and the powder. The boundary layer is believed to eliminate powder friction, particulate interaction, and permits enhanced powder flow.

The porous member further comprises a gas pressure source on one side of the member and which gas pressure traverses the porous member away from the source and towards the powder thereby forming a gaseous boundary layer between the porous member and the powder. The gas can be, for example, compressed oxygen, nitrogen, argon, helium, and the like gases, and mixtures thereof. The compressed gas enhances particulate flow and particulate throughput by aerating the particle mass. The porous liner can be constructed of any suitable porous and durable material, for example, a resilient and flexible porous polymeric resin such high density polyethylene.

The apparatus of the present invention can include a spiral screw auger for urging the particulate powder downward through the funnel. The dimensions of the auger preferably closely conforms to the internal dimensions of the housing as defined by the internal diameter measured from the porous member.

The funnel housing has a hollow, substantially conofrustrical shape, the hollow conofrustrical portion defining a cavity therein, The cavity can have a variable diameter which approximates the outer diameter and taper of the auger member residing therein, for example, from about 0.25 inches to about 24 inches.

The apparatus of the present invention provides a powder handling and filling system with improved powder flow and powder throughput. The powder flow and powder throughput of the apparatus in embodiments can be enhanced from about 10 to about 200 percent, and preferably from about 25 to about 175 percent, and most preferably from about 50 to about 150 percent, compared to an apparatus with a funnel without a porous internal wall and the gaseous boundary layer. The powder can be, for example, a toner, a carrier, a developer, a mineral, a pigment, a dye, a resin, a formulated resin, and the like particulate materials, and mixtures thereof. The powder can be any flowable particulate material.

The apparatus can further comprise separately or in combination: a receiver member situated below the open end of the funnel for receiving and containing powder discharged therefrom; a deflector operably associated with the funnel for deflecting the powder into the receiving vessel as it exits the funnel; a vacuum source operably associated with the funnel for removing stray powder from the funnel, for example, at the exit port where the funnel engages a receiving vessel; and a conveyor and elevator assembly for advancing the receiver members to and from a fill location near the discharge end of the funnel. The apparatus further comprising a converging nozzle attached to the outlet end of the funnel to reduce the diameter of the funnel to approximate the diameter of the receiver member.

The apparatus of the present invention when used in conjunction with a continuous particulate powder source and an endless source of receiving vessels provides a particulate powder processing and filling method comprising:

placing a first powder container to be filled in filling relationship to a funnel extending downwardly from a hopper;

directing the powder in the hopper toward a funnel located at least partially within the hopper, the a funnel defining a restriction therein;

defining an inlet cross sectional area perpendicular to the flow the powder and outlet defining an outlet cross sectional area perpendicular to the flow the powder;

selecting the inlet cross sectional area to be larger than the outlet cross sectional area, for example, the ratio of inlet to outlet areas can be from about 1.1:1 to about 5:1, and preferably from about 1.1:1 to about 3:1;

selecting the dimensions of the funnel to provide a ratio of the inlet cross sectional area to the outlet cross sectional area such that the flow of powder does not seize as it progresses through the nozzle;

dispensing powder from the hopper through the funnel feature and into a first container;

removing the first container from the funnel; and placing a second container to be filled in filling relationship to the hopper.

The process can be reliably repeated indefinitely with substantially no failure of the particle dispenser, for example, resulting from the powder bridging, clogging or caking in the funnel.

Referring to FIG. 1, there is shown the toner filler apparatus 100 of the present invention including the funnel assembly 2. Also shown is receiver conveyor 142 and receiver elevator assembly 138, reference the aforementioned commonly owned and assigned U.S. Pat. Nos. 5,685,348 and 5,699,842, and copending application U.S. Pat. No. 08/923,016

In FIG. 2, there is shown a side view in partial cross section of the apparatus of the present invention comprising a conventional hopper 110, for example, as used in toner filling operations, which hopper surmounts the funnel assembly 2 and in turn a container or receiver vessel 112. A cone shaped hopper 110 directs particles from the hopper 110 to and through the funnel assembly comprised of a rotating auger 114, which is housed within funnel 116. Funnel 116 and auger 114 convey the particulate material to the container 112 through discharge port 118. A typical optional spring return closure 120 provides particle shutoff and control capability. A typical closure 120 has an operable member 122 and a fixed member 123. Container 112, when lifted into position, acts on member 122 which slides on cylindrical part 115. When container 112 is in position, the operable member 122 is moved enough to expose ports 118. When filling is complete, container 112 is lowered. Compression springs 125 slide operable member 122 to close ports 118 thereby shutting off the incidental flow of particulate materials. In embodiments, an optional vacuum dust pickup and associated vacuum source within member housing 122 can be employed to attract, contain, and remove stray dust particulates thereby further maintaining sanitary internal and external ambient conditions. To facilitate particulate flow within the funnel 116, there is provided a gas permeable porous lining or wall 124 which enables, for example, compressed air entering nozzle 126 from gas and thereafter self distributing within gas distribution manifold or chamber 127 to substantially uniformly traverse the porous liner 124 and pass into the auger-particulate region of the funnel. Chamber 127 and porous lining 124 circumscribe the auger 114, preferably for substantially the entire length where the funnel and auger interface, and provides for a substantially uniform distribution of compressed air into the particulate mass 128 being conveyed through the funnel 116.

In FIG. 3 there is shown a cross-sectional side view further detailing the apparatus of the present invention. When a uniform flow of gas through the porous liner is opposed by the outward pressure of the particulate material driven by the auger, there is believed to be created an insulating boundary layer of gas 210 further described below. Referring to FIG. 4, there is shown in cross section, and in enlarged scale of a portion of FIG. 3, funnel wall 216, chamber manifold 227, and porous liner 224. When air is continuously pumped through the porous liner 224, while particulate material is present and while the auger is rotating, there is established a boundary layer or void space 210 between the porous liner and the particulate material. Although not desired to be limited by theory, it is believed that the void space provides boundary layer 210 or slip stream of air which reduces the coefficient of friction of the interior wall of the funnel and therefore the friction force of the particulate material or toner on the wall of the funnel. Other benefits which arise from the present invention include reduction or elimination of, for example, frictional or auger noise during operation, and particulate material blocking or clumping, and particulate masses seizing the auger. The properties of the particulate material are generally unaffected and typically flow properties of the particulate material in the aerated funnel filler are improved as a result of enhanced agitation and fluidization of the particulate material therein. Compared to prior art approaches to funnel flow problems, for example, wherein the funnel is lined with a low friction and low wetting material, such as, TEFLON®, in the present invention there is little, if any, wear on the porous lining, which further enhances the reliability and desirability of the present apparatus for use in particulate conveyance and fill operations, especially xerographic toner materials including color toners.

The gas permeable porous lining 124 can be constructed of any suitable gas permeable material, for example, POREX® products which includes a family of ultra porous plastic materials, such as, polyethylenes, polypropylenes, polyvinylidene fluorides, polytetrafluoroethylenes, polyesters, polyethersulfones, and the like materials, commercially available from Porex Technologies, Corporation, Fairburn, Ga. Other suitable porous lining materials include, for example, porous powdered metals and metal alloys, such as copper-zinc, copper-tin, and the like metals and mixed metals having porosities and gas permeabilities comparable to the POREX® plastic materials.

Pore sizes in the porous liner can be from about 0.1 micron to about 50 microns, and preferably from about 10 to about 30 microns. In an exemplary embodiment for example, for filling cartridges with toner particles which have, for example, a nominal toner particle size of about 10 to about 25 microns, the nominal pore size of the porous liner can be from about 10 to about 25 microns. Unexpectedly, the porous liner apparently does not clog, even upon extended use in continuous toner cartridge fill operations, with toner particles of like or lesser size. An absence of clogging, blocking, fouling, and the like flow and fill problems in the present apparatus are believed to be attributable to the aforementioned boundary layer between the inner wall of the funnel and the advancing particulate mass provided by the gas or air flow through the porous membrane liner.

The gas flow rates employed for optimum particulate flow and fill results using the apparatus of the present invention can be highly dependent upon variables such as the particle size, particle size distribution, material type(s), packing and adhesion characteristics of the particles, auger speed, fill rates, size or scale of the auger filler, and the like variables. These and other variables can be readily adjusted and controlled to regulate the fill rates of the apparatus of the present invention. Typical gas flow rates can be from about 0.1 to about 10 cubic feet per minute, and preferably from 0.2 to from about 5 cubic feet per minute.

The present invention is applicable to many particulate feed, discharge, and fill operations, for example, toner fill operations and reliably combining toner constituents in for example, pre-extrusion and extrusion operations. Thus, the receiver member can be selected from, for example, an extruder, a melt mixing device, a classifier, a blender, a screener, a variable rate toner filler, a bottle, a cartridge, a container for particulate toner or developer materials, and the like static or dynamic particulate receptacles.

Other modifications of the present invention may occur to those skilled in the art based upon a review of the present application and these modifications, including equivalents thereof, are intended to be included within the scope of the present invention.

What is claimed is:

1. An apparatus comprising:

a funnel comprising a housing operably connected to a particulate source at one end and extending downwardly therefrom to a receiver member at the other end, said funnel being adapted to permit a flow of powder therethrough, and wherein the inner wall of said funnel is adapted with a porous member;

a gas pressure source on one side of the porous member wherein the gas pressure traverses the porous member away from the gas source and towards the powder thereby forming a gaseous boundary layer between said porous member and the powder;

an auger for urging the powder downward through said funnel; and a reversibly slidable housing adapted to controllably stop and start powder flow from said funnel.

2. An apparatus in accordance with claim 1, wherein the gas is compressed oxygen, nitrogen, argon, helium, or mixtures thereof.

3. An apparatus in accordance with claim 1, wherein the compressed gas enhances particulate flow and throughput by aerating the particle mass.

4. An apparatus in accordance with claim 1, wherein the porous liner comprises high density polyethylene.

5. An apparatus in accordance with claim 1, wherein said auger closely conforms to the internal dimensions of said housing.

6. An apparatus in accordance with claim 1, wherein the porous member is comprised of a resilient and flexible polymer.

7. An apparatus in accordance with claim 1, wherein at least a portion of said funnel housing has a hollow, substantially conofrustrical shape, the hollow conofrustrical portion defining a cavity therein.

8. An apparatus in accordance with claim 1, wherein said boundary layer eliminates powder friction, particulate interaction, and permits enhanced powder flow.

9. An apparatus in accordance with claim 1, wherein powder flow and throughput of the apparatus is enhanced from about 10 to about 200 percent compared to an apparatus with a funnel without said gaseous boundary layer.

10. An apparatus in accordance with claim 1, wherein powder flow and throughput of the apparatus is enhanced from about 50 to about 150 percent compared to an apparatus with a funnel without said gaseous boundary layer.

11. An apparatus in accordance with claim 1, wherein the powder is a toner, a carrier, a developer, a mineral, a pigment, a dye, a resin, a formulated resin, any flowable particulate material, and mixtures thereof.

12. An apparatus in accordance with claim 1, wherein the apparatus further comprising a deflector operably associated with said funnel for deflecting the powder as it exits said funnel.

13. An apparatus in accordance with claim 1, wherein the apparatus further comprises a vacuum source operably associated with said funnel for removing stray powder from said funnel.

14. An apparatus in accordance with claim 1, further comprising a converging nozzle attached to the outlet end of the funnel to reduce the diameter of the funnel to approximate the diameter of the receiver member.

15. An apparatus in accordance with claim 1, wherein the apparatus further comprises receiver member situated below the open end of the funnel for receiving and containing powder discharged therefrom.

16. An apparatus in accordance with claim 15, wherein the apparatus further comprises a conveyor and elevator assembly for advancing said receiver members to and from a fill location near the discharge end of the funnel.

17. A method comprising:

placing a first powder container to be filled in filling relationship to a funnel extending downwardly from a hopper of the apparatus in accordance with claim 1;

directing the powder in the hopper toward the funnel located at least partially within the hopper, the funnel defining a restriction therein;

defining an inlet cross sectional area perpendicular to the flow the powder and outlet defining an outlet cross sectional area perpendicular to the flow the powder;

selecting the inlet cross sectional area to be larger than the outlet cross sectional area;

selecting the dimensions of said funnel to provide a ratio of the inlet cross sectional area to the outlet cross sectional area such that the flow of powder does not seize as it progresses through the nozzle;

dispensing powder from the hopper through the funnel feature and into a first container;

removing the first container from the funnel so that the powder flow through the funnel stops; and placing a second container to be filled in filling relationship to the hopper so that the powder flow through the funnel resumes.

18. A method in accordance with claim 17, wherein the ratio of inlet to outlet cross sectional areas is from about 1.1:1 to about 5:1.

* * * * *